United States Patent [19]

Yukawa et al.

[11] Patent Number: 4,748,435

[45] Date of Patent: May 31, 1988

[54] HIGH-VOLTAGE RESISTANCE WIRE

[75] Inventors: Yoshimi Yukawa; Yoshio Watanabe; Yoshinori Serizawa, all of Gotenba, Japan

[73] Assignee: Yazaki Corporation, Japan

[21] Appl. No.: 432

[22] Filed: Jan. 5, 1987

[30] Foreign Application Priority Data

Jan. 8, 1986 [JP] Japan ..... 61-000796

[51] Int. Cl.[4] ..... H01C 3/06

[52] U.S. Cl. ..... 338/214

[58] Field of Search ..... 338/214, 66; 174/105 SC, 106 SC, 106 R

[56] References Cited

U.S. PATENT DOCUMENTS

| | | | |
|---|---|---|---|
| 2,111,229 | 3/1938 | Thompson | 174/106 SC |
| 3,718,840 | 2/1973 | Tanaka et al. | 338/214 X |
| 3,963,854 | 6/1976 | Fowler | 174/106 R X |
| 4,363,019 | 12/1982 | Miyamoto et al. | 338/214 |

FOREIGN PATENT DOCUMENTS

| | | | |
|---|---|---|---|
| 968004 | 8/1964 | United Kingdom | 338/214 |

*Primary Examiner*—C. L. Albritton

*Attorney, Agent, or Firm*—Wigman & Cohen

[57] ABSTRACT

A high-voltage resistance wire for use in an engine ignition device has a resistive conductor, an insulating layer covering the resistive conductor, and a protctive sheath layer surrounding the insulating layer. The protective sheath layer is loosely fitted to the insulating layer so as to provide a gap of 0.1 mm or greater therebetween. The gap results in a small electrostatic capacitance between the innermost resistive conductor and the outermost protective which improves the ignitability of the resistance wire. Additionally, the protective sheath layer is formed by impregnating or coating silicone resin or fluororesin into or onto a tubular fiber braided body of glass or polyaramide fiber. The protective sheath has an improved flexibility and tearing strength from an end terminal.

11 Claims, 3 Drawing Sheets

HIGH-VOLTAGE RESISTANCE WIRE

BACKGROUND OF THE INVENTION

1. Field of the Invention

The present invention relates to a high-voltage resistance wire for use in an engine ignition device, for instance.

2. Description of the Prior Art

The background of the present invention will be explained with respect to its application to an engine ignition device installed in an automotive vehicle.

In an engine ignition device, a high-voltage (e.g. 25 to 30 kv) resistance wire is used to obtain an appropriate resistance. Examples of the prior-art high-voltage resistance wire of this sort are disclosed in Japanese Published Unexamined Pat. Appl. No. 54-140190, for instance, as shown in FIGS. 1 and 2 of the present specification.

In FIG. 1, the high-voltage resistance wire is made up of a resistive conductor 1, an insulating layer 2 covering the resistive conductor 1, and a protective sheath layer 3 for protecting the insulating layer 2. In this prior-art resistance wire, however, since the protective sheath layer 3 is formed in close contact with the insulating layer 2, it is necessary to decrease the outer diameter of the resistive conductor 1 or to increase the outer diameters of the insulating layer 2 and the protective sheath layer 3, in order to decrease the electrostatic capacitance between the resistive conductor 1 and the protective sheath layer 3. Therefore, there exists a problem in that it is difficult to lower the electrostatic capacitance of the resistance wire, and therefore ignitability of an engine ignition device using the resistance wire is low.

In addition, since the protective sheath layer 3 of this prior-art resistance wire is made of rubber, the mechanical strength (e.g. tear resistance) of the protective sheath wire 3 is subject to degradation, in particular when temperature rises within an engine housing. There thus exists another problem in that the protective sheath layer 3 is easily torn away from a metallic end terminal T, as shown in FIG. 3, attached to an wire end for facilitating connection of the wire to another element; that is, the tearing strength or the tear resistance of the protective sheath layer is not sufficiently high against the wire end terminal.

FIG. 2 shows another example of the prior-art high-voltage resistance wire. This wire is made up of a resistive conductor 1, a protective sheath layer 3, and many insulating spacers S intervening between the conductor 1 and the sheath layer 3 to form some spaces 4 therebetween. In this resistance wire, although the dielectric strength is high and the electrostatic capacitance is low, since some spaces are formed by intervening spacers between the conductor 1 and the sheath layer 3, another problem exists in that the wire is bulky without contributing to the space-saving requirements of the engine housing. Additionally, the bendability or flexibility of the wire is low because of the presence of the spacers S.

SUMMARY OF THE INVENTION

With these problems in mind, therefore, it is the primary object of the present invention to provide a high-voltage resistance wire in which electrostatic capacitance between the resistive conductor and the protective sheath layer is small and therefore ignitability when used with an engine ignition device is high.

Another object of the present invention is to provide a high-voltage resistance wire strong in tear resistance of the protective sheath layer from an attached metallic end terminal at both room and high temperatures.

Yet another object of the present invention is to provide a high-voltage resistance wire which has excellent bendability or flexibility, which has a small external wire diameter, and which is light in weight.

To achieve the above-mentioned objects, the high-voltage resistance wire according to the present invention comprises: (a) a resistive conductor; (b) an insulating layer for covering the resistive conductor; and (c) a protective sheath layer loosely fitted to the insulating layer with a gap between an outer surface of the insulating layer and an inner surface of the protective sheath layer. The gap distance between the two is about 0.1 to 0.5 mm. The protective sheath layer is formed by impregnating or coating silicone resin or fluororesin into or onto a tubular fiber-braded body of glass or polyaramide fiber.

In the resistance wire according to the present invention, since a gap or a space is formed between the middle insulating layer and the outermost protective sheath layer, it is possible to reduce the electrostatic capacitance between the innermost resistive conductor and the outermost protective sheath layer, so that ignitability can be improved when the wire is connected to an engine ignition device.

Further, since the outermost protective sheath layer is formed by impregnating or coating silicone resin or fluororesin into or onto a tubular fiber (glass or polyaramide) braided body, in place of the conventional rubber sheath, it is possible to decrease the wall thickness of the protective sheath layer or to increase the tearing strength of the sheath layer from an end terminal at high temperature, as compared with the conventional resistance wire having a rubber sheath layer.

BRIEF DESCRIPTION OF THE DRAWINGS

The features and advantages of the high-voltage resistance wire according to the present invention will be more clearly appreciated from the following description taken in conjunction with the accompanying drawings in which like reference numerals designate the same or similar elements throughout the figures thereof and in which:

FIG. 6 (*b*) is a similar representation showing the tearing strength of the sheath layer at high temperature.

DETAILED DESCRIPTION OF THE PREFERRED EMBODIMENTS

Figure 4:
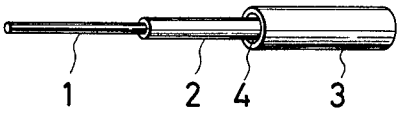
FIG. 4 is a perspective view showing the embodiment of the resistance wire according to the present invention.
Figure 5:
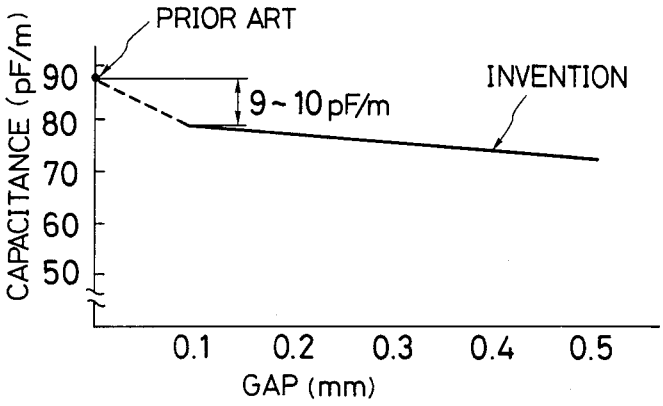
FIG. 5 is a graphical representation showing the relationship between the gap distance and the electrostatic capacitance.
Figure 6:
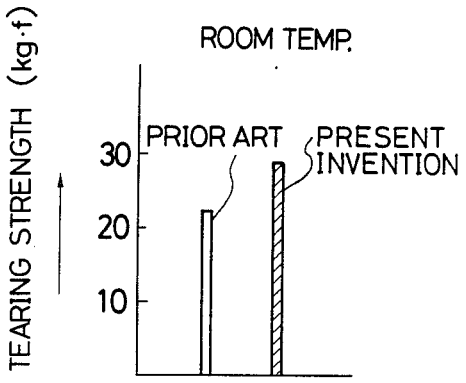
FIG. 6 (*a*) is a graphical representation showing the tearing strength of the wire against a metallic end wire terminal at room temperature.
Figure 6:
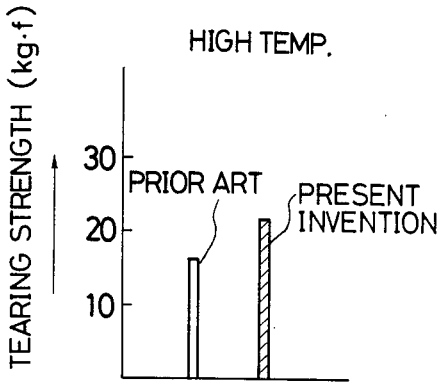

With reference to FIGS. 4 to 6, the high-voltage resistance wire according to the present invention will be described in detail.

FIG. 4 shows the embodiment of the present invention. The resistance wire is made up of an innermost resistive conductor 1, an intermediate insulating layer 2, and an outermost protective sheath layer 3. The feature of the resistance wire according to the present invention is to form a space or a gap between the intermediate insulating layer 2 and the outermost protective sheath layer 3. In a typical example, the outer diameter of the resistive conductor 1 is about 1.14 mm; that of the insulating layer 2 is about 4.8 mm, and that of the protective sheath layer 3 is about 6 mm. Further, the inner diameter of the protective sheath layer 3 is about 5 mm. Therefore, a gap 4 or space of about 0.1 mm is formed between the insulating layer 2 and the protective sheath layer 3. Other dimensions for the resistive conductor, insulating layer, and protective sheath are possible, with the gap distance between the insulating layer 2 and the protective sheath ranging from about 0.1 mm to about 0.5 mm.

The resistive conductor 1 is formed in accordance with the following steps: a core made of glass fiber or polyaramide fiber is first prepared; a conductive addition reaction silicon rubber composite as shown in Table 1 below is extruded onto the core so as to cover the core; a braided material of glass fiber is wound around the extruded silicon rubber composite; a conductor fluorine rubber paint is applied onto the braided glass fiber; and lastly the conductive rubber paint is dried.

TABLE 1

| Component | Weight % |
|---|---|
| Addition reaction silicon rubber | 66 |
| Conductive particles | 30 |
| Silicon oil | 2 |
| Nickel oxide | 2 |
| Resistibility (Ohm · $cm^{-1}$) | 3.2 |

The insulating layer 2 is made of a rubber-like substance EPDM (ethylene-propylene diene monomer) obtained by adding diene monomer (as a third component) to ethylene-propylene copolymer, and formed by extruding polyolefine base rubber composite, excellent in waterproof properties, as shown in Table 2 below, onto the resistive conductor 1 so as to cover the conductor 1. Further, in Table 2, phr is an abbreviation for parts per hundred of rubber.

TABLE 2

| Additive | Quantity |
|---|---|
| Base polymer | 100 phr |
| Processing aid | 2-5 phr |
| Antioxidant | 0.5-5 phr |
| Plasticizer | 0-50 phr |
| Filler/reinforcer | 100-200 phr |
| Vulcanizing/vul. accelerator | 1-10 phr |

The protective sheath layer 3 is formed by impregnating silicone resin (varnish) or fluorine contained resin into a tubular fiber-braided body of glass fiber or polyaramide fiber such as Kevlar fiber (Trademark of Du Pont Corp.). Instead of impregnating the above resin thereinto, it is also possible to coat the silicone resin or fluororesin onto the tubular glass or polyaramide fiber braided material.

FIG. 5 shows the relationship between the gap 4 formed between insulating layer 2 and the protective sheath layer 3 and the electrostatic capacitance per unit wire length (1 mm) formed between the resistive conductor 1 and the protective sheath layer 3. This graph indicates that the capacitance (pF/m) of the embodiment is lowered by about 9 to 10 pF/m when the gap distance is about 0.1 mm, as compared with that of the prior-art silicon rubber sheath wire in which the sheath is in close contact with the insulating layer 2.

In this connection, ignitability representative of generative ability of an electric spark in an engine ignition device is closely related to the electrostatic capacitance of the resistant wire. In other words, the smaller the electrostatic capacitance of the resistance wire is, the higher will be the ignitability, because an ignition voltage can rise at a high speed when a high voltage is applied to the ignition device.

Figure 1:
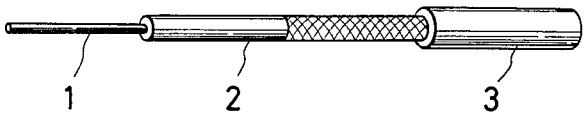
FIG. 1 PRIOR ART
FIG. 1 is a perspective view showing a first example of the prior-art high-voltage resistance wire.
Figure 2:
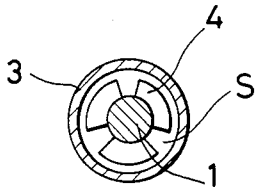
FIG. 2 PRIOR ART
FIG. 2 is an enlarged cross-sectional view showing a second example of the prior-art resistance wire.
Figure 3:
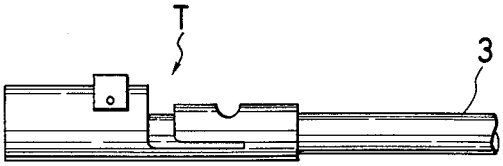
FIG. 3 PRIOR ART
FIG. 3 is a side view showing an end terminal attached to a wire end, for assistance in explaining the tear strength of the sheath layer against the end terminal.

FIGS. 6 (*a*) and (*b*) show the tearing strength between the wire end (e.g. an end of the protective sheath layer) and a metallic end terminal member T (See FIG. 3) attached to an end of the wire to facilitate connection of the wire to another member, in comparison between the wire of the present invention and the prior-art wire, at both room and high temperatures. These graphs indicate that the tearing strength can be improved by 30 to 35% over that of the prior-art wire. Further, FIGS. 6 (*a*) and (*b*) show the test results obtained for the resistance wire including a protective sheath layer 3 in which silicon varnish is impregnated into a tubular glass fiber braided body.

Further, the outer diameter of the protective sheath layer 3 is about 6 mm, as already mentioned, while that of the rubber sheath layer of the prior-art wire is about 8 mm. That is, the outer diameter of the resistance wire according to the present invention can be reduced about 2 mm, as compared with that of the conventional one, thus reducing the weight of the wire.

In addition to the above embodiment of the resistance wire according to the present invention, the resistive conductor 1 can be formed in a different way. That is, a composite as shown in Table 3 below is extrusion molded into a wire state; metal wire is wound around the molded body in the axial direction thereof in such a way that the outer diameter of the resistive conductor 1 becomes about 1.5 mm. Further, in this modification, the outer diameter of the insulating layer 2 is about 4.8 mm, the same as that of the embodiment described before.

In this modification of the resistance wire according to the present invention, it is possible to decrease the electrostatic capacitance, the outer diameter, and the weight per length, and to increase the tearing strength between the wire and the end terminal.

TABLE 3

| Component | Quantity |
|---|---|
| Silicon rubber | 100 phr |
| Vulcanizer | 1.2 phr |
| Ferrite | 600 phr |

In the resistance wire according to the present invention, it should be noted that the protective sheath layer is made of a tubular braided body of glass fiber or Kevlar fiber and additionally the tubular braided body is coated by flexible silicone resin or fluororesin. Therefore the wire of the present invention is strong enough for tension and compression caused when the wire is bent; that is, the bendability or flexibility is high. This higher bendability of the wire is advantageous when the wire is bent and distributed near and around an engine.

As described above, in the high-voltage resistance wire according to the present invention, since the inner diameter of the outermost protective sheath layer has a dimension which is a little greater than the outer diameter of the intermediate insulating layer so that the sheath layer is loosely fitted to the insulating layer with an appropriate gap therebetween, it is possible to reduce the electrostatic capacitance between the innermost resistive conductor and the outermost protective sheath layer without degrading the bendability or flexibility of the wire. Thus the ignitability of the wire is improved when connected to an engine ignition device.

Further, since the outermost protective sheath layer is formed by impregnating or coating silicone resin or fluororesin into or onto a tubular braided material of glass or Kevlar (polyaramide) fiber in place of the conventional rubber sheath, it is possible to improve the tearing strength of the wire against an end terminal, while reducing the wire diameter and wire weight.

Furthermore, since the protective sheath layer according to the present invention can be formed without use of an extrusion molding machine as in the conventional wire, it is possible to economize the equipment cost of manufacturing the wire of the present invention.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A high-voltage ignition resistance wire, comprising:

(a) a resistive conductor;

(b) an insulating layer covering said resistive conductor, said insulating layer having an outer surface; and (c) a protective sheath layer having an inner surface surrounding said insulating layer and loosely fitted to said insulating layer so as to form a gap between the outer surface of said insulating layer and the inner surface of said protective sheath layer, said protective sheath being formed by applying a resin onto a tubular fiber braided body.

2. The high-voltage resistance wire as set forth in claim 1, wherein the gap between said outer surface of the insulating layer and said inner surface of the protective sheath layer is from 0.1 to 0.5 mm in distance.

3. The high-voltage resistance wire as set forth in claim 1, wherein said sheath layer comprises a tubular fiber braided body and a resin impregnated into said tubular fiber braided body.

4. The high-voltage resistance wire as set forth in claim 3, wherein the resin impregnated into the tubular fiber braided body is silicone resin.

5. The high-voltage resistance wire as set forth in claim 3, wherein the resin impregnated into the tubular fiber braided body is fluororesin.

6. The high-voltage resistance wire as set forth in claim 1, wherein said sheath layer comprises a tubular fiber braided body and a resin coated on said tubular fiber braided body.

7. The high-voltage resistance wire as set forth in claim 6, wherein the resin coated onto the tubular fiber braided body is silicon resin.

8. The high-voltage resistance wire as set forth in claim 6, wherein the resin coated onto the tubular fiber braided body is fluororesin.

9. The high-voltage resistance wire as set forth in claim 1, wherein the tubular fiber braided body is made of glass fiber.

10. The high-voltage resistance wire as set forth in claim 1, wherein the tubular fiber braided body is made of polyaramide fiber.

11. The high-voltage resistance wire as set forth in claim 1, wherein said high-voltage resistance wire is used with an engine ignition device.

* * * * *